US011418873B2

(12) United States Patent
Simon

(10) Patent No.: US 11,418,873 B2
(45) Date of Patent: Aug. 16, 2022

(54) SURVEILLANCE MICROPHONE

(71) Applicant: Edward J. Simon, Sharpsburg, PA (US)

(72) Inventor: Edward J. Simon, Sharpsburg, PA (US)

( * ) Notice: Subject to any disclaimer, the term of this patent is extended or adjusted under 35 U.S.C. 154(b) by 0 days.

(21) Appl. No.: 17/306,785

(22) Filed: May 3, 2021

(65) Prior Publication Data

US 2022/0141576 A1 May 5, 2022

Related U.S. Application Data

(60) Provisional application No. 63/109,070, filed on Nov. 3, 2020.

(51) Int. Cl.

| | |
|---|---|
| ***H04R 1/34*** | (2006.01) |
| ***H04R 19/04*** | (2006.01) |
| ***H04R 3/00*** | (2006.01) |
| ***H04R 1/32*** | (2006.01) |
| ***H04R 1/04*** | (2006.01) |
| ***H04R 7/04*** | (2006.01) |
| ***H04R 1/08*** | (2006.01) |
| ***H04R 7/18*** | (2006.01) |

(52) U.S. Cl.

CPC ..... *H04R 1/342* (2013.01); *H04R 1/04* (2013.01); *H04R 1/08* (2013.01); *H04R 1/326* (2013.01); *H04R 3/00* (2013.01); *H04R 7/04* (2013.01); *H04R 19/04* (2013.01); *H04R 7/18* (2013.01)

(58) Field of Classification Search

None

See application file for complete search history.

(56) References Cited

U.S. PATENT DOCUMENTS

| | | | |
|---|---|---|---|
| 3,115,207 | A | 12/1963 | Wiggins |
| 4,536,887 | A | 8/1985 | Kaneda et al. |
| 6,963,653 | B1 | 11/2005 | Miles |
| 7,366,310 | B2 | 4/2008 | Stinson et al. |

(Continued)

FOREIGN PATENT DOCUMENTS

| | | | |
|---|---|---|---|
| CA | 2 420 989 | A1 | 9/2003 |
| KR | 101010099 | B | 1/2011 |
| WO | 2004/016041 | A1 | 8/2002 |

OTHER PUBLICATIONS www.spysource.net/soundprox.htm.

*Primary Examiner* — Kenny H Truong

(74) *Attorney, Agent, or Firm* — Cynthia S. Lamon; Lamon Patent Services

(57) ABSTRACT

An acoustic microphone assembly for surveillance into a protected space includes a microphone including a transducer and a diagram adapted for picking up acoustic sound waves, electronic circuitry for processing input, a power source, and an audio output wire or trace for delivering processed digital sound to a sound system, a cover plate having at least two bolt openings for mounting to a base plate on a wall or structure the cover plate covering an opening there through into the protected space, the cover plate accepting an orthogonal mounting of the microphone, and a sound diffraction pattern of different sized openings placed through the cover plate, the sound diffraction pattern located in alignment to the mounted microphone head and having a foot print roughly equal to the circumference of the head of the microphone.

9 Claims, 4 Drawing Sheets

(56) References Cited

U.S. PATENT DOCUMENTS

| | | | | |
|---|---|---|---|---|
| 8,111,192 | B2 | 2/2012 | Taenzer | |
| 8,422,702 | B2 | 4/2013 | Kim et al. | |
| 2016/0167946 | A1* | 6/2016 | Jenkins | H04R 19/005 257/416 |
| 2017/0134850 | A1* | 5/2017 | Graham | H04R 1/2876 |
| 2020/0068297 | A1* | 2/2020 | Rollow, IV | H04R 1/406 |

* cited by examiner

SURVEILLANCE MICROPHONE

CROSS-REFERENCE TO RELATED DOCUMENTS

The present invention claims priority to a U.S. provisional patent application Ser. No. 63/109,070 entitled SURVEILLANCE MICROPHONE filed on Nov. 3, 2020, disclosure of which is included herein.

BACKGROUND OF THE INVENTION

1. Field of the Invention

The present invention is in the field of sound detection and pertains particularly to methods and apparatus for improving the uniformity and directional access of a microphone relative to sound input into the microphone.

2. Discussion of the State of the Art

In the sound wave instrument industry, which includes sound amplification, directional or omnidirectional output or input of sound by speakers and microphones, diffraction devices, gratings, and speaker shapes may be used to better project and intake sound having both higher and lower frequencies measured by step rise in wave form and wavelength. Essentially the function of a microphone is to collect or "pick up" acoustic sound waves and to convert the sound waves into a digital signal that can be recorded and or increased in amplitude and broadcast as sound to cover intended spaces.

Typically speaking, sound may be diffracted or forced around objects to attenuate differences between high and low frequency sound waves. Speakers and playback systems may have utilities or designs adapted to mix and manipulate the sound to ensure low frequency sounds are equal to higher frequency sounds and, overall, the different sources of the sound recorded by microphone and output by an amplifier and speaker are audible in a projected coverage area of the one or more speakers. In microphones, there are different designs that specialize in certain types of sound detection profiles according to the general purpose of the microphone.

For example, a base tone microphone tends to be a unidirectional microphone that is adapted to detect and capture lower bass tones as opposed to higher frequencies. A microphone used for capturing ambient sounds from many directions is typically an omnidirectional microphone. A drummer's microphone clipped to a drum rim may be unidirectional to pick up the taps on that particular drum and cancelling out background noise. An overhead drum microphone may be omnidirectional to capture sound emanating from the entire drum set for ambient sense.

Another area where microphones are an important tool is in the area of surveillance and security. For example, a room or hall monitored by video may also include microphones to pick up sounds made that may be important in determining intent of a person captured on video. In jails and other institutions where incarceration takes place such as temporarily before inmate processing, or in security cells rooms where inmates may visit, exercise, and so on, microphones are used in recording systems and communication systems to pick up the speech of conversations held which might be relevant to a criminal case one way or another.

A problem with supplying and using microphones in jail rooms is that often there are bad acoustics like sound reflection or bouncing, echo effects, and other sound distortion phenomena. Humans can hear frequencies between about 20 Hertz (Hz) and 20,000 Hz. The most important frequencies for speech and language are between 250 Hz and 8,000 Hz. Likewise, in some cases there may be multiple conversations and ambient sounds many of which may pose an interruption to the quality of sound a recording or an intercom system and may be undecipherable after reproduction because of noise associated with different frequencies closer to or further away from the microphone. It is desired that sound may be more separated, and coverage angle and area may be improved relative to a surveillance microphone. Another issue is providing electronics equipment in a security environment in a fashion that prevents tampering or destruction of the equipment.

Therefore, what is clearly needed is a diffraction plate for enhancing acoustic sound waves coming from a surveillance space into a microphone having at least a diaphragm as a pickup or transducer for acoustic sound. The plate may also provide protection for the internal microphone parts.

BRIEF SUMMARY OF THE INVENTION

According to one embodiment of the present invention, an acoustic microphone assembly for surveillance into a protected space is provided including a microphone, a transducer, and a diagram adapted for picking up acoustic sound waves, electronic circuitry for processing input, a power source, and an audio output wire or trace for delivering processed digital sound to a sound system, a cover plate having at least two bolt openings for mounting to a base plate on a wall or structure; the cover plate covering an opening there-through into the protected space with the cover plate accepting an orthogonal mounting of the microphone, and a sound diffraction pattern of different sized openings placed through the cover plate; the sound diffraction pattern located in alignment to the mounted microphone head and having a foot print roughly equal to the circumference of the head of the microphone.

In one embodiment, the microphone is an omnidirectional capacitive microphone. In another embodiment, the microphone is an electrostatic pressure-gradient microphone. In one embodiment, the cover plate includes two or more sound diffraction patterns for two or more mounted microphones. In a preferred embodiment, the diffraction pattern includes a center opening of a larger size, a star pattern of openings of a uniform moderately smaller size disposed on a bolt circle concentric to the center opening, and a ring of smaller more numerous openings disposed on a larger concentric pattern of circles also concentric to the center opening. In one embodiment, openings are circular holes.

In one embodiment, the size and arrangement of the openings in the diffraction pattern are adapted to improve omnidirectional stability of the microphone reducing any loss of sound detection in the range of 3,000 to 6,000 Hz in light of various angular positions of the sound source or sources relative to the mounted position of the microphone in the microphone assembly. In one embodiment, the mounted microphone is enclosed in a security housing also mounted to the cover plate. In one embodiment, the base plate wall or structure may be shared with one or more video cameras and the structures include one or a combination of wall plates, ceiling plates, and bolted benches or tables.

DETAILED DESCRIPTION OF THE INVENTION

In various embodiments described in enabling detail herein, the inventor provides a unique sound diffraction cover plate for a surveillance microphone that improves the coverage pattern for the microphone. The present invention is described using the following examples which may describe more than one relevant embodiment falling within the scope of the invention.

In sound surveillance using a microphone, the microphone may typically become more directional as the sound wave frequency increases. It is a goal of the present invention to provide a surveillance microphone with an adaptation for diffracting incoming sound waves to improve perimeter wave detection at frequencies of interest.

Figure 1:
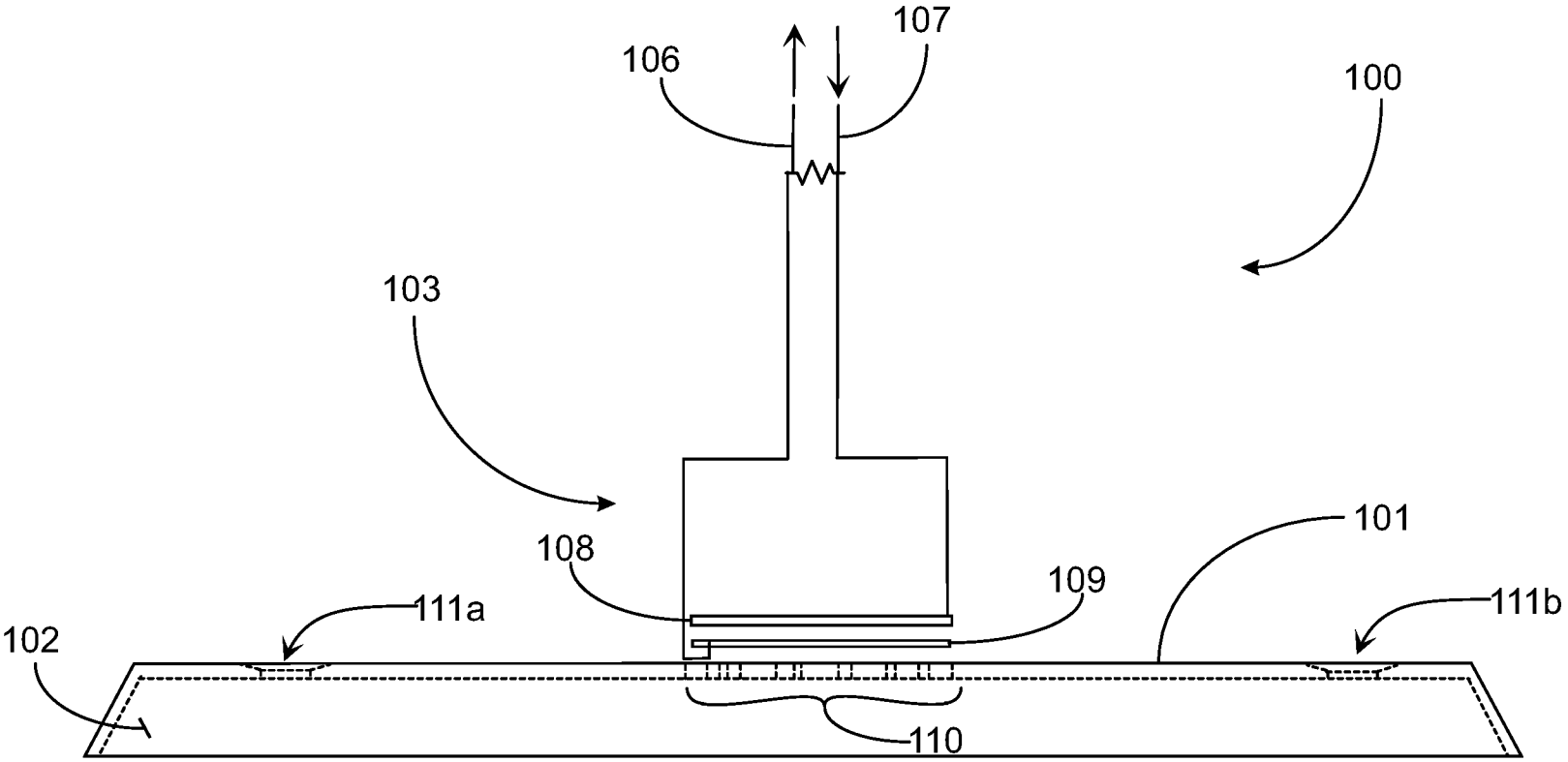
FIG. 1 is a side elevation view of a diffraction cover plate in position under a surveillance microphone.

FIG. 1 is a side elevation view 100 of a diffraction cover plate in position under a surveillance microphone. View 100 depicts a surveillance microphone 103 mounted to or otherwise abutted flush against a sound diffraction cover plate 101. Surveillance microphone 103 includes sound pick up circuitry that is driven and powered by electricity to capture acoustic sound waves and convert those into a digitized electronic audio signal that may output to a recording system, a speaker system, or a communications system. Surveillance microphone 103 may be an electrostatic pressure-gradient microphone capsule mounted essentially flush in or behind especially flat mounting surfaces and may include a diaphragm tightly mounted on a diaphragm ring, an electrode, and, possibly, an acoustic friction or acoustic resistance device.

Diffraction cover plate 101 is a rectangular cover plate having a length and width and a material thickness. Diffraction cover plate 101 has a perimeter wall 102 having a height dimension and a material thickness dimension that may be uniform to the material. Diffraction cover plate 101 may be fabricated of stainless steel or another material that may be stamped or otherwise formed by material bend to created perimeter wall 102.

In a preferred embodiment, diffraction cover plate 101 is mountable to a base plate mounted to a wall or other secure structure inside or having access to a monitored space, the base plate (not depicted) having an opening there through large enough to enable sound waves from inside the monitored space to travel through the wall or hard structure such as a table or other secure mounted apparatus and into microphone 103 through a circular sound wave diffraction pattern 110 provided in the major plate surface of the cover plate 101. Diffraction cover plate 101 includes at least two chamfered mounting holes 111*a* and 111*b* for accepting mounting screw hardware for mounting the plate over a wall opening or structure access opening into a monitored room space.

Diffraction pattern 110 is a circular-hole pattern of through holes placed through the major wall of cover plate 101. Diffraction pattern 110 may have roughly the same overall pattern diameter as, or just greater than, the length of a rectangular diaphragm plate 109, which is the transducer device in this embodiment that picks up acoustic sound waves diffracted into the microphone. Diffraction pattern 110 forms a sound wave diffraction barrier between acoustic sound waves traveling into microphone 103 and the sound pick-up diaphragm 109. Though not discernible in this view, the circular hole pattern of diffraction plate 102 includes a single larger center hole surrounded by a pattern of holes of moderately smaller diameter; this pattern of holes in turn is surrounded by a ring of even smaller holes generally arranged just outside of the perimeter of the microphone pickup apparatus.

A diaphragm plate 109 and a back plate 108 form a capacitive pickup for capturing acoustic sound waves of varying frequencies and amplitudes. A power-in path 107 may connect to an outside plug wire wherein the plug wire includes a standard voltage-regulated charger or plug in device (not illustrated) to connect to the microphone and associative circuitry. The arrows at the rear of surveillance microphone 103 include a power-in path 107 and an audio signal path out through signal line 106 (directional arrows).

Microphone 103 may be another type of omnidirectional microphone other than a capacitive omnidirectional microphone without departing from the spirit and scope of the present invention. In a preferred embodiment, an omnidirectional microphone is preferred for surveillance applications. Electronics associated with microphone 103 are not depicted in this view but may be assumed present. Microphone 103 is oriented and aligned over diffraction pattern 110 approximately in the center of the rectangular cover plate 101 in this embodiment. In another embodiment, there may be more than one microphone and diffraction pattern in a single cover plate without departing from the scope of the invention.

Figure 2:
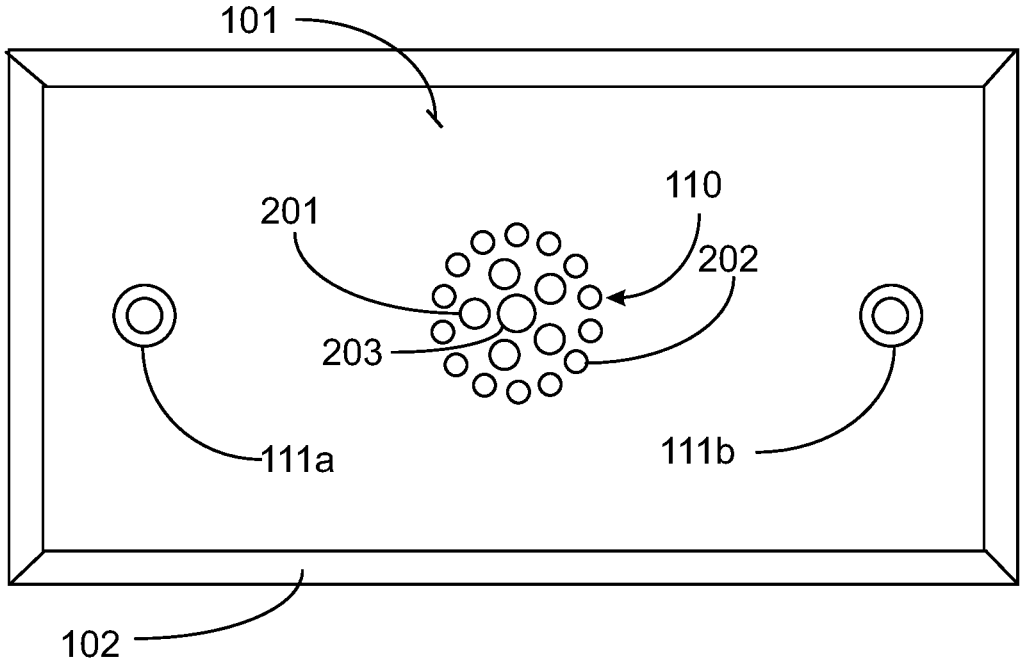
FIG. 2 is a front elevation view of the diffraction cover plate of FIG. 1.

FIG. 2 is a front elevation view of diffraction cover plate 101 of FIG. 1. In this view, diffraction pattern 110 is depicted on the side of the cover plate that interfaces with microphone 103 of FIG. 1. Diffraction pattern 110 comprises a center-hole 203 of a comparatively larger diameter than smaller holes 201 which are, in turn, larger than smallest holes 202. Diffraction pattern 110 includes a star pattern (five equal-diameter holes) of smaller holes 201 arranged in a pattern of equal-distant holes in a circular pattern that is concentric to center hole 203. Diffraction pattern 110 also includes a distal perimeter pattern of more numerous smallest holes 202 arranged in a circular pattern concentric with smaller holes 201 and center-hole 203.

The pattern of holes described above creates the diffraction effect desired to prevent high frequency loss to microphone 103 at the frequency range of most interest between 3,000 and 6,000 hertz (Hz). Sound entering through diffraction plate 101 at diffraction pattern 110 is diffracted in a manner as to shape the sound promoting better (wider) coverage patterning before the sound enters microphone 103 and contacts diaphragm plate 109 of FIG. 1.

In this embodiment, diffraction cover plate 101 has a single diffraction pattern at approximate center for service to one omnidirectional microphone such as microphone 103 described in FIG. 1.

In another embodiment, there may be more than one sound diffraction pattern like pattern 110 in cover plate 101 if more than one microphone is deployed. Typically, the face of the microphone is in alignment with diffraction pattern 110 with a security housing (not depicted) provided to cover the microphone and associated electronics.

The secure surveillance mic design of this invention inhibits a tendency for the omnidirectional microphone 103 to trend toward unidirectional performance because of the smaller wavelength of higher frequency sound waves and enables better preservation of sound in the frequency range of interest that might otherwise be reduced or lost by directional tendencies of the microphone in a non-diffracted state. This diffraction effect provides a better coverage pattern area for the microphone in the monitored space. The apparatus of the invention may be employed in locations where video cameras are present and may be securely mounted to tamper free structures such as in wall plates, steel bolted tables and benches, and in ceiling structures. The box form protects the microphone and components from compromise by tampering.

Figure 3:
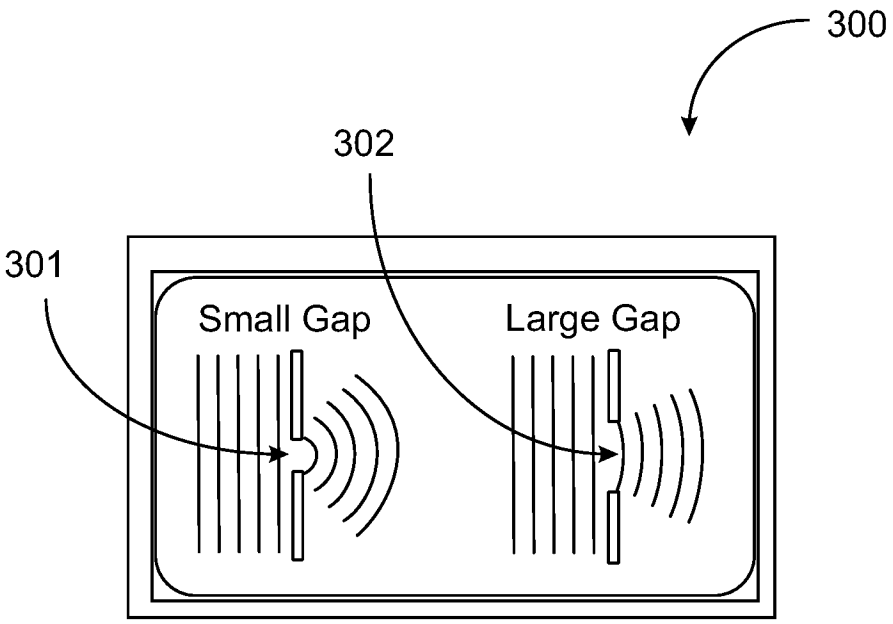
FIG. 3 is a block diagram depicting acoustic sound waves emerging through different size openings in a barrier plate.

FIG. 3 is a block-diagram 300 depicting acoustic sound waves emerging through different size openings in a barrier plate. Referring now to FIG. 3, diagram 300 depicts a sound barrier plate with a small opening or gap 301 and a second sound barrier plate with a larger opening or gap 302.

In this view, the sound waves are passing through the gaps from left to right. One may observe that the angle of dispersion on sound waves through gap 302 (larger diameter), has less of a coverage pattern than do the sound waves emerging through the smaller hole or gap 301. The half wavelength of a sound wave at the upper limit of the frequency range of interest, at about 10,000 Hz, is approximately seven-tenths of an inch to three-quarters of an inch in diameter. The diameter of each hole used to diffract the sound wave may be smaller than the half-wavelength. In this light, the inventor has designed the hole patterns to include the single hole 203, the star pattern of smaller holes 201, and the perimeter ring of smallest holes 202 of diffraction pattern 110 from FIG. 2 to improve omnidirectional stability for microphone 103 of FIG. 1 and prevent loss of sound detection in the range of 3,000 to 6,000 Hz regardless of angular position of the sound source relative to the surveillance microphone.

Figure 4:
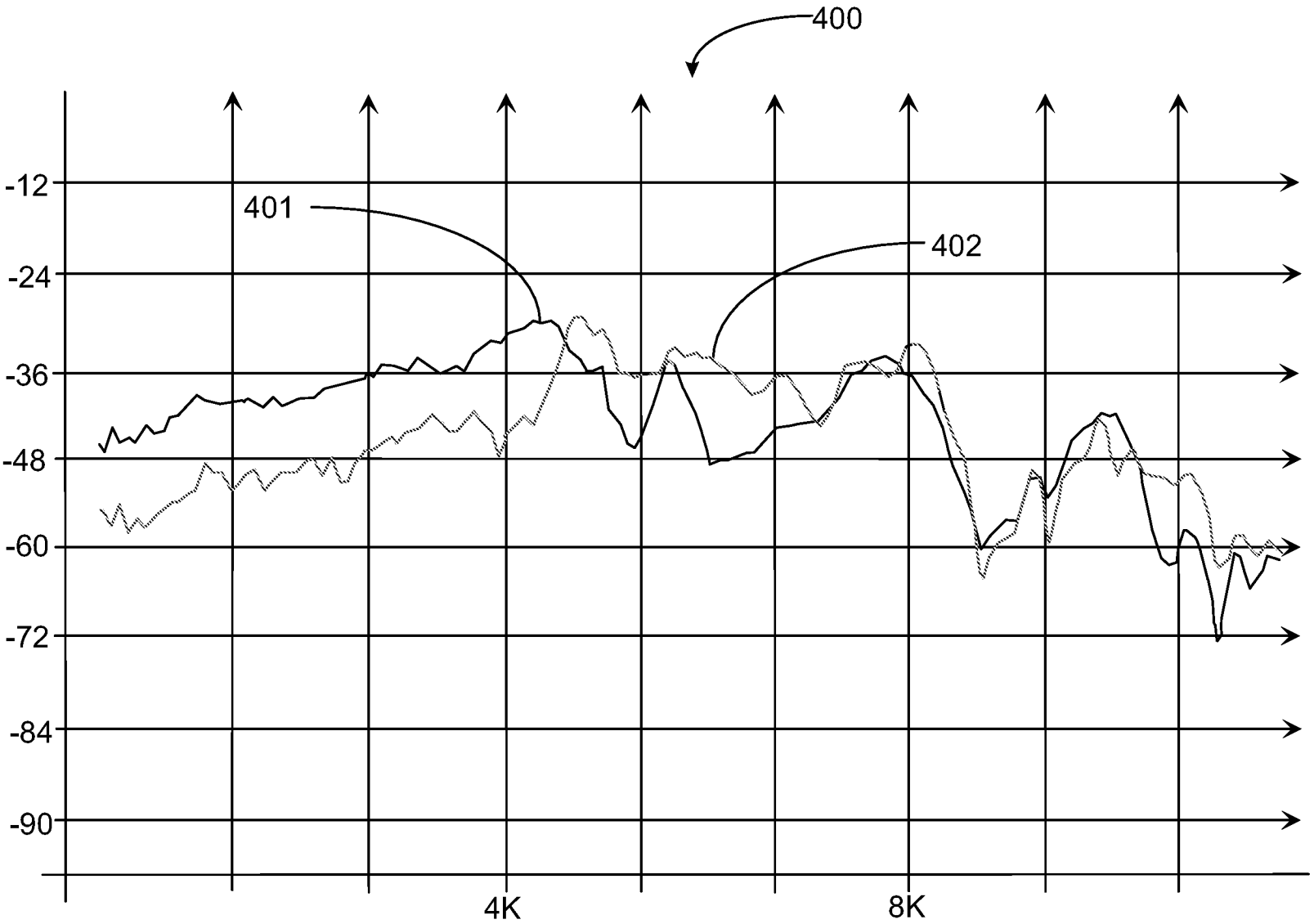
FIG. 4 is a chart depicting microphone pick-up frequency response through the diffraction plate.

FIG. 4 is a line graph depicting microphone pick-up sensitivity through the diffraction plate. Chart 400 has an x axis in Hz and a Y axis in sound decibel level. The black line is measuring pickup on axis wherein the sound source is directly in front of the microphone. The gray line is the same measurement wherein the sound source is off axis 90 degrees to the microphone center.

In empirical testing, the unit the Inventor built and tested had from a 90-degree angle to the sound source 3 dB increased level pick-up in the important frequency range of 3,000 to 6,000 hertz (cycles per second.) The resulting no loss of sound in the frequency range of interest in either angular direction of center of the microphone allows improved omnidirectional performance of the microphone for enhanced intelligibility.

It will be apparent with skill in the art that the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. An acoustic microphone assembly for surveillance into a protected space comprising:

a microphone including a transducer and a diagram adapted for picking up acoustic sound waves, electronic circuitry for processing input, a power source, and an audio output wire or trace for delivering processed digital sound to a sound system;

a cover plate having at least two openings for mounting to a base plate on a wall or structure with fasteners, the cover plate covering an opening there through into the protected space, the cover plate accepting an orthogonal mounting of the microphone; and a sound diffraction pattern of different sized openings placed through the cover plate, the sound diffraction pattern located in alignment to the mounted microphone head and having a footprint roughly equal to the circumference of the head of the microphone.

2. The acoustic microphone assembly of claim 1, wherein the microphone is an omnidirectional capacitive microphone.

3. The acoustic microphone assembly of claim 1, wherein the microphone is an electrostatic pressure-gradient microphone.

4. The acoustic microphone assembly of claim 1, wherein the cover plate includes two or more sound diffraction patterns for two or more mounted microphones.

5. The acoustic microphone of claim 1, wherein the diffraction pattern includes a center opening of a larger size, a star pattern of openings of a uniform moderately smaller size disposed on a bolt circle concentric to the center opening, and a ring of smaller more numerous openings disposed on a larger bolt circle also concentric to the center opening.

6. The acoustic microphone assembly of claim 5, wherein the openings are circular holes.

7. The acoustic microphone assembly of claim 1, wherein the size and arrangement of the openings in the diffraction pattern are adapted to improve omnidirectional stability of the microphone reducing any loss of sound detection in the range of 3,000 to 6,000 Hz in light of various angular positions of the sound source or sources relative to the mounted position of the microphone in the microphone assembly.

8. The acoustic microphone assembly of claim 1, wherein the mounted microphone is enclosed in a security housing also mounted to the cover plate.

9. The acoustic microphone assembly of claim 1, wherein the base plate wall or structure may be shared with one or more video cameras and the structures include one or a combination of wall plates, ceiling plates, and bolted benches or tables.

* * * * *